US005465600A

United States Patent [19]

Goff, Jr. et al

[11] Patent Number: 5,465,600

[45] Date of Patent: Nov. 14, 1995

[54] DIE ASSEMBLY

[75] Inventors: Kenneth H. Goff, Jr., Plymouth; William E. Schultz, Canton, both of Mich.

[73] Assignee: Ford Motor Company, Dearborn, Mich.

[21] Appl. No.: 246,589

[22] Filed: May 20, 1994

[51] Int. Cl.[6] ..... B21D 37/00

[52] U.S. Cl. ..... 72/309; 72/413; 72/481; 72/381

[58] Field of Search ..... 72/413, 412, 309, 72/308, 381, 386, 481; 83/698.31, 698.71

[56] References Cited

U.S. PATENT DOCUMENTS

| | | | |
|---|---|---|---|
| 1,404,911 | 1/1922 | Klocke . | |
| 1,521,265 | 12/1924 | Anderson | 72/481 |
| 1,572,142 | 2/1926 | Hood | 72/481 |
| 2,105,391 | 1/1938 | Almdale | 72/481 |
| 2,107,581 | 2/1938 | Parsons | 83/698.31 |
| 2,146,828 | 2/1939 | Liss | 72/309 |
| 2,331,491 | 10/1943 | Menkin | 113/42 |
| 3,020,888 | 2/1962 | Braun | 121/40 |
| 3,456,478 | 7/1969 | Alexander | 72/351 |
| 3,561,248 | 2/1971 | Bessho | 72/383 |
| 3,595,061 | 7/1971 | Bessho | 72/381 |
| 3,802,246 | 4/1974 | Goff | 72/381 |
| 3,802,247 | 4/1974 | Karsnak | 72/405 |
| 4,273,738 | 6/1981 | Spengler | 264/154 |
| 4,753,099 | 6/1988 | Klingel | 72/389 |
| 4,951,552 | 8/1990 | Fox | 92/27 |
| 5,190,272 | 3/1993 | Zika et al. | 269/309 |
| 5,216,913 | 6/1993 | Post | 72/446 |
| 5,251,969 | 10/1993 | Cezanne et al. | 303/963 |
| 5,253,502 | 10/1993 | Poletti | 72/213 |

FOREIGN PATENT DOCUMENTS

| | | | |
|---|---|---|---|
| 2225528 | 12/1973 | Germany | 72/413 |
| 3637566 | 5/1988 | Germany | 72/481 |
| 94647 | 6/1960 | Netherlands | 72/381 |

*Primary Examiner*—Daniel C. Crane

*Attorney, Agent, or Firm*—Joseph W. Malleck; Roger L. May

[57] ABSTRACT

A die assembly (10) for shaping a workpiece (12). The die assembly (10) includes a die shoe (22) within which a channel (24) is provided. A hollow die head (32) may move within the channel. One or more passages are disposed within the die head (32). Within each passage is a locking member (46) which is seatable within a groove (52) defined within a head portion (50) of a shaft (48) which transmits a shaping force to the workpiece (12) or a driven or shaping force within the die assembly (10), thereby allowing the shaft (48) to rotate axially. The die assembly (10) permits the die head (32) and shaft (48) to move in unison during the initial stages of retraction. During later stages of retraction, the die head (32) becomes unlocked from the shaft ( 48).

14 Claims, 4 Drawing Sheets

DIE ASSEMBLY

TECHNICAL FIELD

This invention relates to a die assembly for shaping a workpiece.

BACKGROUND ART

In manufacturing operations, "stamping" is a general terms that covers almost all press operations. It includes blanking, shearing, hot or cold forming, drawing, bending, and coining. Common among such operations is the objective of developing a less expensive method of producing sheet metal stampings, for example, of steel or aluminum. Especially in manufacturing "niche" or low volume vehicles, set up costs and down time must be minimized in order to produce efficient operations. Thus, it would be desirable to reduce the number of operations, particularly at production volumes of less than about 30,000 units per year from about seven steps to about three or four steps. Additionally, it would be desirable to eliminate tooling which is part-specific, so that once mounted, given tooling could be used to shape more than one part. Such manufacturing objectives are particularly important when one considers entry into a new vehicle market with minimum initial investment.

Thus, there has been a general interest in performing a large variety of small-lot production operations for automobile-related industries which conventionally specialize in mass production. In an era of diversification and personalization of the user's needs, there is a requirement for varied production of small lots to make it possible to meet the variously changing needs efficiently and accurately.

One such manufacturing system is the Toyota Flexible Press System (FPS). This system uses three basic operations per part (form/trim/finish) as compared with about 4–7 operations per part in conventional high volume stamping operations. In the Flexible Press System, a high variety, small volume production line exists for automobile body panels. The production line includes three processes: (1) hydraulic press forming; (2) high-speed three-dimensional carbon dioxide laser cutting; and (3) "multi-press" forming. However, the FPS uses relatively expensive return springs or compressed gas (e.g. nitrogen) cylinders to cause components to move within the die assembly.

In conventional stamping operations, there frequently is a-need for actuators that include a locking mechanism for holding a ram in an extended position. Illustrative is U.S. Pat. No. 4,951,552, which discloses a locking cylinder in which a locking ball is positioned within a ball passageway so that the balls do not project therefrom. Such mechanisms, however, do not readily lend themselves to low volume stamping operations. Nor do they disclose a structure which holds the ram during the initial stages of retraction. Additionally, it is doubtful that an invention disclosed in the '552 patent permits axial rotation of the shaft.

SUMMARY OF THE INVENTION

To meet the needs of advanced manufacturing technology in small volume production lots, what is needed is a single stage forming operation which has the ability to form from all sides, as well as from the top and bottom, so that the benefits of reduced tooling investment, shorter tooling lead time, and improved product marketing flexibility may be realized. Preferably, new press designs should offer the opportunity to access the workpiece from three sides.

Also needed is a variable operational press which unifies the die "sub-set" and "parent" press into one interacting unit, thereby permitting a decrease in part-specific tooling. To accomplish this, a press must have some of the mechanical attributes of the main die sets in a conventional press line. Such attributes must become press functions, and not die functions.

The present invention addresses the needs of multi-press forming. In the disclosed multi-press forming operation, there is a die assembly which shapes a workpiece in cooperation with a stamping press having a reciprocally movable platen and a bolster between which the workpiece is located. Typically, a platen refers to a face of a bolster, slide, or ram to which a tool assembly may be attached. A platen generally transmits pressure or force.

The die assembly includes a die shoe attached to the bolster. The die shoe has a stepped channel defined by neck, body, and shoulder portions. Within the channel, a hollow die head is adapted to move axially, radially, or both axially and radially. The die head has a cylindrical wall within which are defined a plurality of passages. A ball is positionable within each passage.

A shaft is provided for transmitting a shaping force to the workpiece via the die head. The shaft has a head portion which defines an annular arcuate groove, the groove being adapted to seat the balls when the shaft retreats from an extended position. When the shaft returns to a retracted position, the die head and the shaft move in unison. As the balls clear the shoulder portion of the channel, they disengage from the shaft so that the shaft becomes unlocked from the die head.

Thus there is provided a die assembly which allows positive return of the die mechanism, while permitting the die head to be unlocked from the shaft. This feature also facilitates rapid die changing.

Further features and advantages of the present invention will be apparent from the following detailed description taken in conjunction with the accompanying drawings.

BEST MODE(S) FOR CARRYING OUT THE INVENTION

Figure 1:
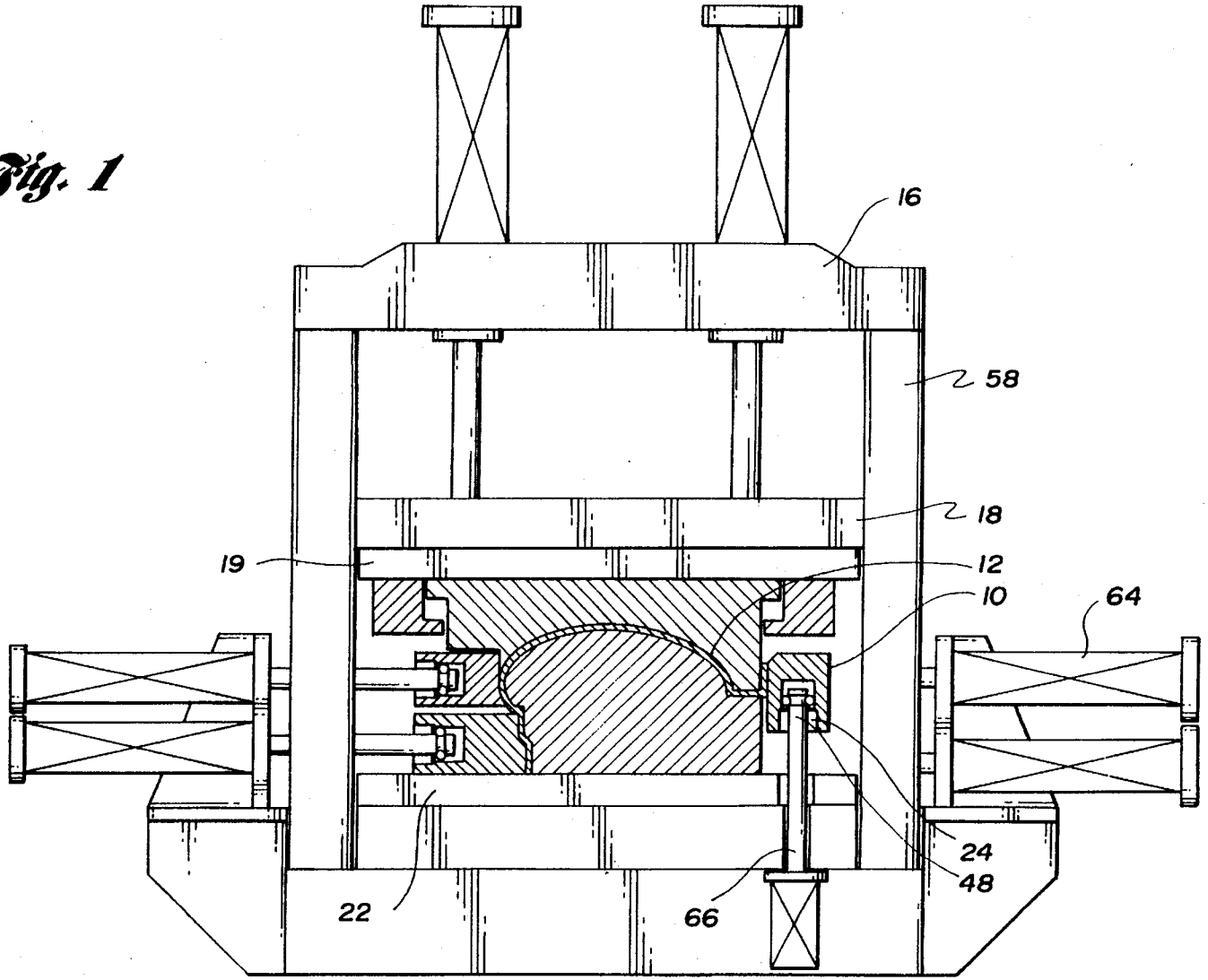
FIG. 1 depicts an operating environment within which a die assembly according to the present invention is situated.
Figure 2:
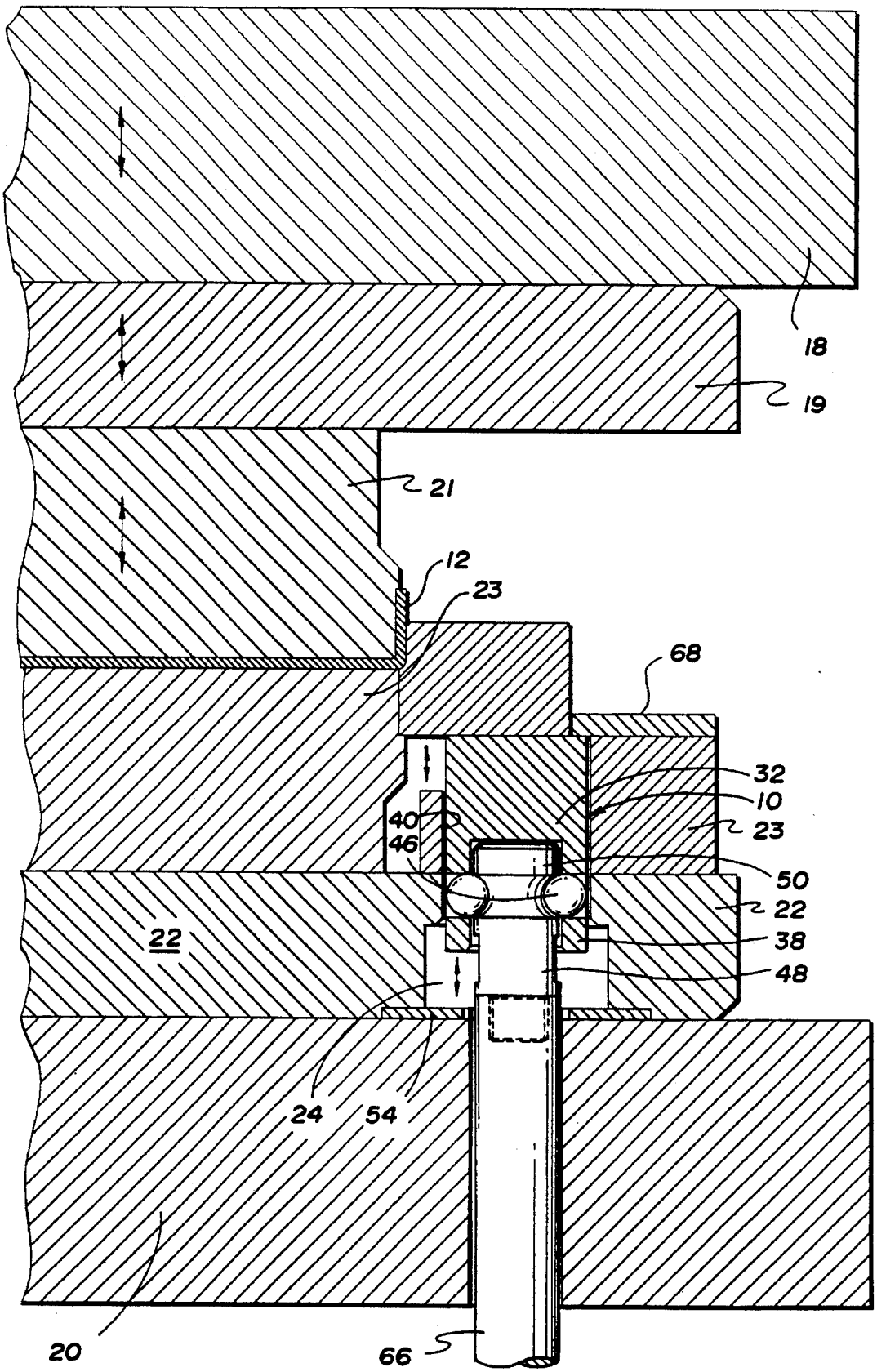
FIG. 2 is an enlarged cross sectional view of the die assembly.

In FIGS. 1–7 of the drawings, there is depicted a die assembly 10 for shaping a workpiece 12 in cooperation with a stamping press having a crown 16. The stamping press has a reciprocally moving platen 18 and a bolster 20 between which the workpiece 12 is located. In FIG. 2, the environment in which the die assembly 10 of the present invention is located is depicted. That environment includes the platen or press ram 18, upper die shoe 19, and upper forming section 21. The workpiece 12 is located between the upper forming section 21 and the lower forming section 23.

Figure 3:
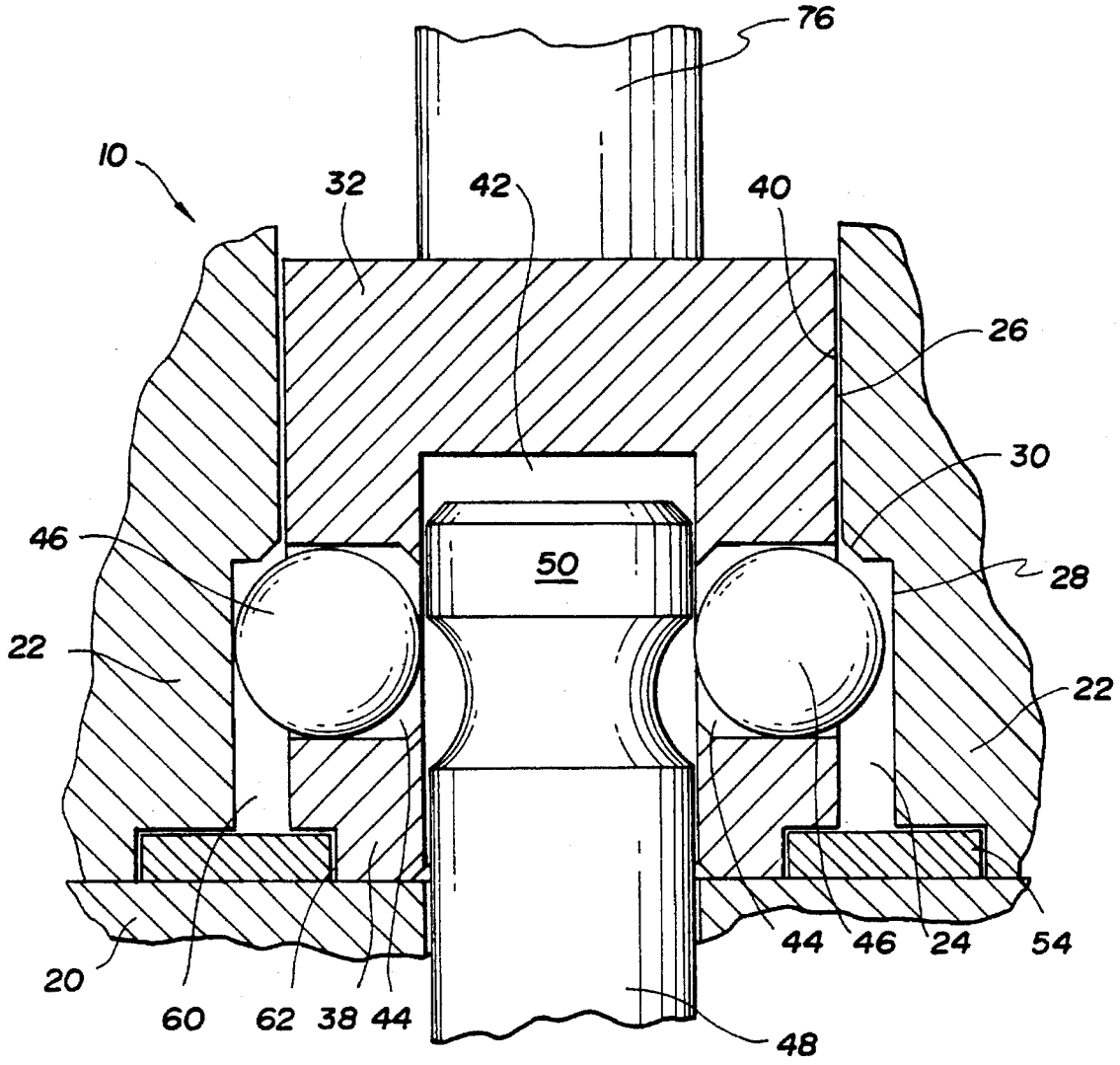
FIG. 3 depicts a cross section in which there is shown additional detail of the die assembly.

The die assembly 10 comprises a die shoe 22 (FIGS. 2–3) attached to the bolster 20. Conventionally, a bolster serves as a plate to which dies may be fastened, the assembly being secured to the top surface of a press bed. The lower die shoe 22 defines therewithin a stepped channel 24 (FIGS. 1–3). The stepped channel 24 has a neck portion 26 (best seen in FIG. 3), a body portion 28, and a shoulder portion 30 therebetween.

With primary reference to FIGS. 2–3, a hollow die head 32 is adapted to move axially, radially, or both axially and radially within the channel 24. The die head 32 may be displaced from an extended position (FIG. 2) through an intermediate position (FIG. 3) to a retracted position (not shown).

Figure 6:
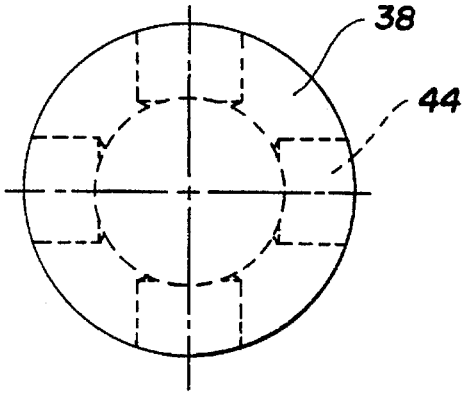
FIG. 6 is a top view of a hollow die head within the die assembly.
Figure 7:
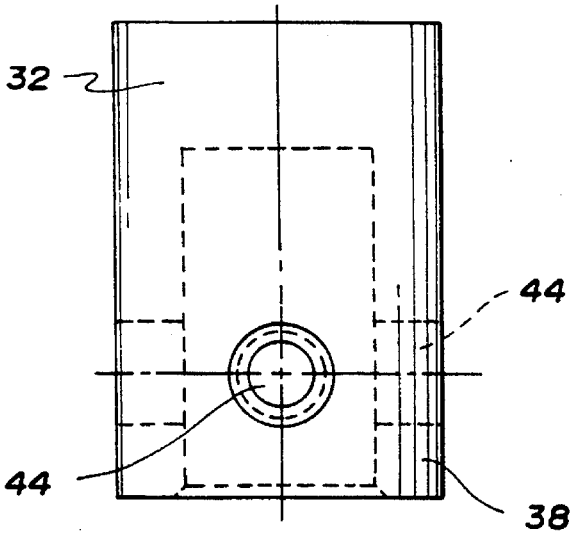
FIG. 7 is a side elevational view of the die head.

The die head 32 has a cylindrical wall 38 (FIGS. 2–3; FIGS. 6–7). The wall 38 has an outer surface 40 which slidably cooperates with the neck portion 26 (FIG. 3) of the channel. Forward motion of the die head 32 is arrested by an up stop 68 which is affixed to the lower forming surface 23. An axially extending chamber 42 is defined within the cylinder wall. Disposed radially through the cylinder wall 38 is a plurality of passages 44, as depicted in FIGS. 6–7. The passages 44 extend from the outer surface 40 to an inner surface thereof. Positioned within each passage 44 is a ball 46. Each passage 44 has a reduced diameter throat portion 45 that retains the ball 46 within the passage when the shaft 48 is retracted.

Figure 4:
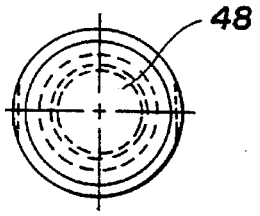
FIG. 4 is an end view of a shaft positioned within the die assembly.
Figure 5:
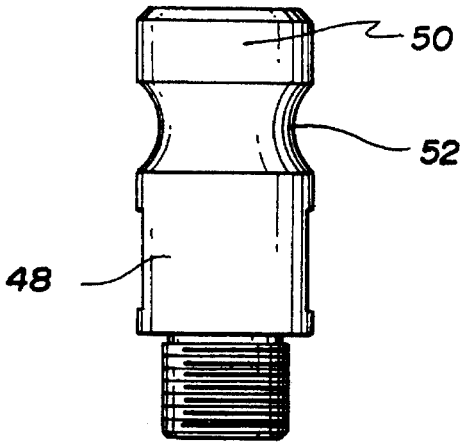
FIG. 5 is a side elevational view of the shaft.

For transmitting a shaping force to the workpiece via the die head 32, a shaft 48 is provided. The shaft 48 is an extension of ram and bolster actuating pins 66. The shaft 48 is best shown in FIGS. 3–5. The shaft 48 has a head portion 50 that is locatable within the chamber 42. The head portion 50 defines an annular arcuate groove 52 in which the balls 46 may be seated when the shaft 48 retreats from the extended position. When the shaft 48 returns to the retracted position through intermediate positions, the die head 32 and the shaft 48 move in unison. The balls 46 disengage from the shaft when they clear the shoulder portion 30 of the channel, thereby unlocking the die head 32 in relation to the shaft 48.

Thus, it will be apparent that the invention presents a mechanism which automatically locks a press and a die assembly together. It should be noted that the locking members or balls 46 are not under load during a thrust cycle. Thrust is applied directly through the shaft 48.

Development efforts have included the use of a 500 ton hydraulic single stage forming press manufactured by Williams & White Co., Moline, Ill. Initial results indicate that the cycle time has been reduced to about 45 seconds from between 1 to 1.5 minutes required by prior art approaches. In the disclosed invention, there may be up to 40 auxiliary ram cylinders and up to 40 auxiliary bolster cylinders. Each may exert 5 metric tons of pressure. In one series of experiments, the ram (upper) cylinders had a 5 inch stroke, while the lower (bolster) cylinders had a 12 inch stroke. Side and rear auxiliary slides were configured at six locations. Each cylinder associated with the slide was capable of applying 40 metric tons of pressure over a 36 inch stroke. Each slide was capable of vertical adjustment.

Turning now to FIGS. 2–3, there is depicted a retainer plate 54 juxtaposed between the die shoe 22 and the bolster 20. The retainer plate 54 engages the wall 38 of the die head 32 upon retraction of the shaft 48, thereby arresting retardation of the die head 32.

The annular groove 52 defined within the head portion 50 of the shaft 48 is provided with an arcuate profile. Preferably, the annular groove 52 is provided with a profile defined by an arc of a circle when the locking members 46 take the form of spheres or balls.

Returning now to FIG. 1, additional detail of the operating environment of the present invention will now be disclosed. The die head 32 within the die assembly 10 is connected to a die mechanism 56 (not shown) which stamps the workpiece. The shaft 48 is connected to a press mounted cylinder which is programmable and stroke adjustable.

Connecting the stamping press 16 (FIG. 1) and the bolster 20 are the press columns 58 which guide the upper platen 18. In that figure, the shaft 48 is oriented parallel to the press columns 58. Also depicted are shafts 64 which are oriented orthogonally to the columns 58. Such an orientation is a more specific example of the general case (not shown) wherein the shaft 48 may be oriented at an angle of inclination to the columns 58.

Turning now to FIG. 3, the shoulder portion 30 of the stepped channel 24 defines a ramp for moving the balls 24 into a seated position within the groove 52 by a closure force. This force is represented by an inwardly directed component of force transmitted axially by the press as the shaft 48 moves toward the extended position.

An under cut region 60 is defined between the outer surface 40 of the cylindrical wall 38 and the body portion 28 of the channel 24. The under cut region 60 permits the balls or locking members 46 to move out of the seated position as the shaft 48 retracts.

One feature of the annular groove 52 is that the locking members 46 may be seated therewithin so that the shaft may rotate in relation to the hollow die head 22, thus permitting the locking members 46 to engage the shaft 48 regardless of its radial position.

In FIG. 4, there is depicted a circumferential notch 62 provided within the die head 32. A retainer plate 54 is juxtaposed between the bolster 20 and the die shoe 22. The retainer plate 54 engages the circumferential notch 62 of the die head 32 upon shaft retraction so that the die head 32 becomes unlocked from the shaft.

In light of the previous disclosure, there has been described a die assembly which permits positive engagement between the shaft 48 and the die head 32 during initial stages of retraction of the shaft. During intermediate and later stages of retraction, the balls separate from the shaft 48 so that the shaft 48 may become unlocked or disengaged from the die head 32. Such features permit setup costs and down time to be minimized in manufacturing "niche" or low volume vehicles. Additionally, the disclosed die mechanism reduces the number of stamping operations to about three or four steps. Thus, the tooling required to form production parts may become more generic, i.e. less part-specific, because once mounted, a given tooling may be used to shape more than one part.

It will be clear to those skilled in the art of constructing die assemblies that various modifications and changes could be made to the assembly described without departing from the spirit and scope of this invention. Accordingly, all such modifications and changes as fall within the scope of the appended claims are intended to be part of this invention.

We therefore claim:

1. A die assembly for shaping a workpiece the die assembly comprising:

a die shoe attached to a bolster of a press, the die shoe defining a channel therewithin;

a hollow die head adapted to move within the channel, the die head having a wall with an outer surface which slidably cooperates with the channel;

an axially extending chamber delimited by the wall; and one or more passages disposed through the wall;

a locking member positionable within each passage, each of the one or more passages being provided with a reduced diameter throat portion which retains the locking members within the associated passage when the shaft is retracted; and a shaft for transmitting a shaping force to the workpiece, the shaft having a head portion that is locatable within the chamber, the head portion defining an annular groove, the groove being adapted to seat the locking members when the shaft retreats so that the die head and the shaft move in unison, the locking members disengaging from the shaft during retraction thereof, thereby unlocking the die head in relation to the shaft.

2. The die assembly of claim 1, further comprising a retainer plate juxtaposed between the die shoe and the bolster, the retainer plate engaging the wall of the die head upon retraction of the shaft, thereby arresting retardation of the die head.

3. The die assembly of claim 1, wherein the annular groove defined within the head portion of the shaft is provided with an arcuate profile.

4. The die assembly of claim 3, wherein the annular groove is provided with a profile defined by an arc of a circle.

5. The die assembly of claim 1, wherein the die head is connected to a die mechanism which stamps the workpiece.

6. The die assembly of claim 1, wherein the shaft is connected to a cylinder which is mounted in the press.

7. The die assembly of claim 1, wherein the shaft is oriented parallel to a press column extending between the bolster and an upper platen of the press.

8. The die assembly of claim 1, wherein the shaft is oriented orthogonally to a press column extending between the bolster and an upper platen of the press.

9. The die assembly of claim 1, wherein the shaft is oriented at an angle of inclination to a press column extending between the bolster and an upper platen of the press.

10. The die assembly of claim 1, wherein the locking members may be seated within the annular groove, and the shaft may rotate in relation to the hollow die head so that the locking members engage the shaft regardless of the radial position of the shaft.

11. A die assembly for shaping a workpiece in cooperation with a stamping press having a reciprocally movable platen and a bolster between which the workpiece is located, the die assembly comprising:

a die shoe attached to the bolster, the die shoe defining therewithin a stepped channel having a neck portion, a body portion, and a shoulder portion therebetween;

a hollow die head adapted to move axially, radially, or both axially and radially within the channel from an extended position in which the workpiece is shaped, to a retracted position, the die head having a cylindrical wall having an outer surface which slidably cooperates with the neck portion of the stepped channel;

an axially extending chamber defined between the cylinder wall; and a plurality of passages disposed radially through the cylinder wall from the outer surface to an inner surface thereof;

a ball positionable within each passage; and a shaft for transmitting a shaping force to the workpiece via the die head, the shaft having a head portion that is locatable within the chamber, the head portion defining an annular, arcuate groove, the groove being adapted to seat the balls when the shaft retreats from the extended position so that when the shaft returns to the retracted position, the die head and the shaft move in unison, the balls disengaging from the shaft when they clear the shoulder portion of the channel, thereby unlocking the die head in relation to the shaft.

12. The die assembly of claim 11, wherein the shoulder portion of the stepped channel defines a ramp for moving the balls into a seated position within the groove by a closure force represented by an inwardly directed, component of force transmitted axially by the press as the shaft moves toward the extended position.

13. The die assembly of claim 12, wherein an undercut region is defined between the outer surface of the cylinder wall and the body portion of the channel, the undercut region permitting the ball to move out of a seated position as the shaft retracts.

14. The die assembly of claim 13, wherein the die head is provided with a circumferential notch; and a retainer plate juxtaposed between the bolster and the die shoe, the retainer plate engaging the circumferential notch of the die head upon shaft retraction so that the die head becomes unlocked from the shaft.

* * * * *